United States Patent [19]

Van Pelt

[11] Patent Number: 4,877,355

[45] Date of Patent: Oct. 31, 1989

[54] UNDERWATER CABLE LAYING SYSTEM

[75] Inventor: Norman Van Pelt, Cocoa Beach, Fla.

[73] Assignee: Casper Colosimo & Son., Inc., Pittsburgh, Pa.

[21] Appl. No.: 183,075

[22] Filed: Apr. 19, 1988

[51] Int. Cl.[4] ..... F16L 1/04

[52] U.S. Cl. ..... 405/159; 405/179; 405/158

[58] Field of Search ..... 405/158, 159, 163, 164, 405/166, 179

[56] References Cited

U.S. PATENT DOCUMENTS

| | | | |
|---|---|---|---|
| 3,333,432 | 8/1967 | Hale . | |
| 3,338,060 | 8/1967 | Harmstorf . | |
| 3,504,504 | 4/1970 | Elliott . | |
| 3,638,439 | 2/1972 | Niederer . | |
| 3,952,532 | 4/1976 | Spearman | 405/164 |
| 4,037,422 | 7/1977 | deBoer et al. | 405/164 X |
| 4,154,551 | 5/1979 | Petrie | 405/159 |
| 4,295,757 | 10/1981 | Gaspar | 405/164 X |

FOREIGN PATENT DOCUMENTS

| | | | |
|---|---|---|---|
| 8300060 | 1/1983 | PCT Int'l Appl. | 405/159 |

*Primary Examiner*—Dennis L. Taylor
*Assistant Examiner*—J. Russell McBee
*Attorney, Agent, or Firm*—Arnold B. Silverman; Suzanne Kikel

[57] ABSTRACT

A cable embedding device comprising a framework for supporting and hydraulically raising and lowering a rock saw and a cable carrying bellmouth relative to two spaced-apart sled-type runners. Each sled carries part of a jet spray system and an eductor system, which spray system creates a slurry and which eductor system carries and discharges the slurry to the back of the device. A hinge and a hinge-roller assembly connect the framework to the device for relative movement therebetween. The bellmouth is shaped to curve around the rock saw, and its pedestal foot supports the bellmouth in the cable embedding and/or trenching operation.

40 Claims, 4 Drawing Sheets

UNDERWATER CABLE LAYING SYSTEM

BACKGROUND OF THE INVENTION

1. Field of the Invention

This invention relates to a method and an apparatus for embedding cable or cable-like members under water at desired depths in either a soil layer, generally referred to as sand overburden or in a substantially solid rock layer. It particularly relates to a method and apparatus for cutting down into rock or hardened surface beds to form a trench; for fluidizing the soil and loosened rock in front of the apparatus; and for conveying this fluidized earthen materials to the back of the apparatus to set the materials back into the trench for easy travel of the apparatus along and for embedding the cable in the seabed or waterbed.

2. Description of the Prior Art

When embedding or burying electric cable or cable-like members, such as plastic pipes at varying depths beneath the bed of rivers, lakes, or other bodies of water, it has been known to employ a cable carrying apparatus which is pulled along the waterbed by a winching device which is either ashore or afloat.

Such a cable embedding apparatus is disclosed in U.S. Pat. No. 3,638,439. The apparatus comprises a waterbed soil depressor member carrying the cable and extending down into the soil along a path cut out by a plurality of jets connected to a source of fluid under pressure for creating a jet flow at a high flow rate and a low pressure to temporarily liquify the waterbed soil in the path of the cable. One of the major drawbacks to this apparatus is that it is not easily adapted to cut through solid surfaces or rock layers. Another drawback is that the depth to which the cable is embedded is restricted to the length of the depressor or cable carrying unit extending into the soil in that the depressor is fixedly secured to the apparatus.

More recent designs provided for both the fluidizing or liquifying of the waterbed soil or sand overburden and the cutting through of rock strata. Such an apparatus is disclosed in a patent application filed on Aug. 29, 1986 bearing U.S. Ser. No. 06/902,146 in the application of Harry Johnson, et al. having the same assignee as the subject patent application. This apparatus employs a soil embedder depressor assembly comprising a bell-mouth and a low pressure jet assembly for fluidizing the soil or sand overburden. For deeper embedment of the cable, this apparatus employs a rock embedder depressor assembly comprising a rotary blade attached to and extending from the rear of the soil embedder depressor assembly. Pivotal movement of both the soil embedder depressor assembly and the rock embedder depressor assembly of this patent application relative to pontoons allows for a deeper reach down into the waterbed with the rock embedder depressor assembly adapted to extend deep into the rock layer.

This latter design for a cable embedding device, however, is complicated in that it employs one means for burying the cable in the sand overburden and a separate means for burying it in the rock layer.

The previously known art provides a means for fluidizing the soil or rock in front of the cable embedder with the fluidized material remaining directly in the path of the embedder whereby a substantial amount of frictional forces still exist resulting in a substantial pulling or towing force for dragging the embedder along the waterbed or the dugout trench.

Other cable embedding devices are described in U.S. Pat. Nos. 3,333,432; 3,338,060; and 3,504,504. U.S. Pat. No. 3,504,504 provides a jaw-scoop type of trenching apparatus with a plurality of eductor jet means and eductor tube means for removing the earthen materials from the cut trench. However, such earthen materials are ejected into the water above the cable embedder, which most likely results in permanent soil displacement.

There is, therefore, lacking in the prior art a teaching of a cable embedder assembly which is simple and compact in design, and is adapted to perform both as a soil cable embedder and a rock cable embedder. There is further lacking in the prior art such an apparatus which conveys the soil and/or rock slurry from in front of its path of travel to the back of the apparatus for backfill of the earthen materials as the apparatus travels along the waterbed or in the trench in the trench making operation.

There is also lacking in the prior art a combination rock-soil cable embedder which easily travels along the waterbed and is adapted to cut down into the rock in a gradual slope for the forming of a trench. There is further lacking in the art, a combination rock-soil cable embedder assembly comprising a rotary saw which is supported by a framework which includes means for lowering the rotary saw and the cable guide member together as a unit and allowing such positioning in at least a two degree freedom of movement with respect to the vertical extent of the embedder assembly. In addition, there is lacking in this type of device a cable guide member with a depressor which is a substantially curved unitary member employed for both a rock and a soil cable embedding operation. This type of apparatus further lacks means for applying both a pressurized jet flow and negative pressure along the front of the apparatus for fluidizing the earthen materials, picking them up and conveying them along the length of the apparatus and then discharging them back into the trench directly behind the cable embedding apparatus.

SUMMARY OF THE INVENTION

The present invention has solved the above described problems by providing a simple, compact combination rock-soil cable embedder assembly for embedding electric cable or cable-like members, such as polethylene pipe, into either the soil or sand overburden layer or into the rock layer of a waterbed. Such assembly is adapted to substantially reduce the frictional forces generally created by the soil and/or rock cuttings along its path of travel in the waterbed. A unique sled or runner arrangement carries jet nozzle means connected to a source of fluid under pressure, and suction means along the front of the assembly for fluidizing and picking up the fluidized slurry. An eductor pipe is carried by a pair of spaced-apart sleds of the runner arrangement of the cable embedder assembly for creating the suctioning effect and for picking up, conveying, and discharging the earthen materials in back of the apparatus, preferably back into the trench for burying the cable. Water from a pumping system is injected into the eductor pipe to create the negative pressure for the suctioning effect, and the jet nozzles are disposed in the near vicinity of the eductor intake area. The cable embedder assembly comprises a rock cutting means and a cable guide member, which member is preferably a one piece structure designed to create a radius near its mouth, extend in a curved fashion around the rock cutting means and form a depressor from which the cable extends. A scraper or ripper portion is provided on the foot of the depressor and jet nozzles connected to a source of fluid under pressure are provided along an inner portion of the leg of the depressor adjacent to the rock cutting means for additional digging action into the sand overburden or rock of the waterbed.

A unique framework structure for supporting the cable guide member and the rock cutting means is mounted on the sleds of the runner arrangement and includes hydraulic means and hinge-roller assembly means for permitting relative movement between the framework structure and the runner arrangement particularly in the trench digging operation.

It is an object of this invention to provide an easily towable, compact cable embedding apparatus for optionally burying the cable in the soil or sand overburden layer of the waterbed or deeper into the rock layer beneath the soil layer.

It is a further object of the invention to provide such a cable embedding apparatus which has a curved one piece cable guide having a bellmouth and a depressor which may be positioned on the same level as that of the top surface of the rock layer and may be moved down into the rock layer in the trench making operation.

A still further object of the invention is to provided a rotary rock cutting means which is supported and lowered with the cable bed guide member as a unit.

A yet still broader object of the invention is to provide a cable embedding apparatus which substantially reduces operational costs and substantially decreases or eliminates the resistance generally due to the loose earthen materials which are in the path of travel.

A further object of the invention is to provide a framework mounted on spaced-apart sleds and comprising several hydraulically operated devices located in two front and two back posts which support and position both the cable guide member and the rock cutting means.

Another object is to provide sleds with a T-shaped slider along which a unique hinge-roller assembly rides and which is connected to the two back posts.

And still a further object of the invention is to provide a method for digging a trench into the rock layer by employing the apparatus described in the preceding objects.

These and other objects of the invention will be more fully understood from the following description of the invention, on reference to the illustrations appended hereto.

DESCRIPTION OF THE PREFERRED EMBODIMENT

As used herein the expression "sand overburden" will refer to the loose soil generally referred to in the prior art as being found in the waterbed above the rock layer and includes the rock cuttings from the rock layer.

The term "rock cuttings" as used herein will refer to the solid pieces of the rock layer cut by the rotary saw in making a trench therein for the cable embedding operation. Slurry refers to the fluidized soil and/or rock cuttings, which fluidization occurs when fluid under pressure is applied to the sand overburden and/or rock cuttings.

Figure 1:
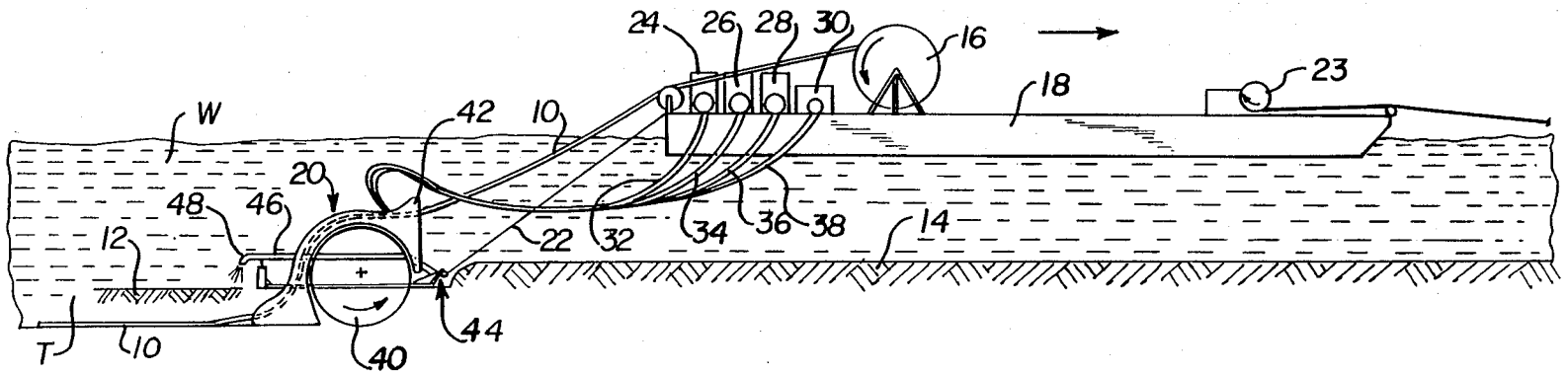
FIG. 1 is an overall diagrammatic view showing the cable embedder assembly of the present invention in operation.

Referring now particularly to FIG. 1, there is shown a cable 10 buried in a trench T of rock layer 12 beneath waterbed 14. Cable 10 is reeled from cable reel 16 on barge 18 which tows cable embedder assembly 20 by means of tow cable 22 and winching system 23 through water W. Several water pumping units 24, 26, 28 and hydraulic power supply unit 30 are mounted on barge 18, and are connected to cable embedder 20 through lines 32, 34, 36, and 38 respectively, which will be discussed in detail hereinafter. Even though not shown in the conventional manner, pump units 24, 26 and 28 receive their water through a suction hose coupled to the suction side of the pump unit and lowered into water W adjacent to the pump unit 24–28. Water is brought into pump units 24, 26, 28 via this suction hose and pumped to units 24–28 through pressure hoses attached.

Figure 2:
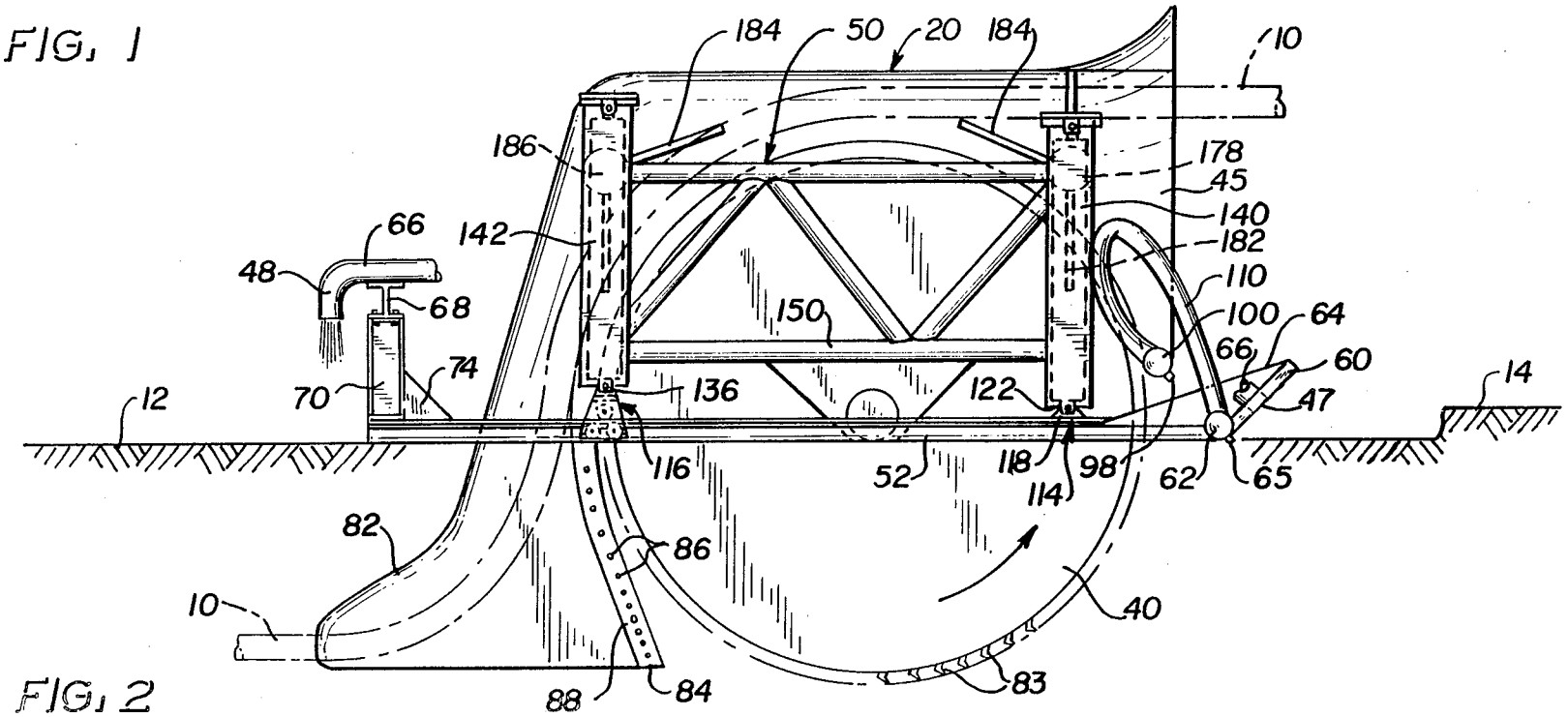
FIG. 2 is a side elevational view of the embedder of the present invention.

FIGS. 1 and 2 particularly show cable embedder 20 as generally having a hydraulically driven rotary saw 40 for cutting through the solid rock layer 12 to dig trench T and a cable guide member 42 for receiving and laying the cable 10. Part of a fluidization system 44 for liquifying or fluidizing the soil and/or rock cuttings is located at the front of embedder 20. Cable guide member 42 has a bellmouth 45 (FIG. 2) whose opening is towards the front of embedder 20 or in the direction of the towing cable 22 to receive cable 10 which is to be laid. An eductor system 46 (FIG. 1) is connected to part of the fluidization system 44. Eductor system 46 picks up the fluidized earthen materials and discharges them back into the formed trench T directly in back of embedder 20 for closing the trench and burying or embedding cable 10 therein. The intake end of eductor system 46 is designated at 47, 49, in FIGS. 2 and 3 and the discharge end is designated at 48 in both FIGS. 1 and 2, which discharged materials are represented by the flow lines as shown therein.

Figure 3:
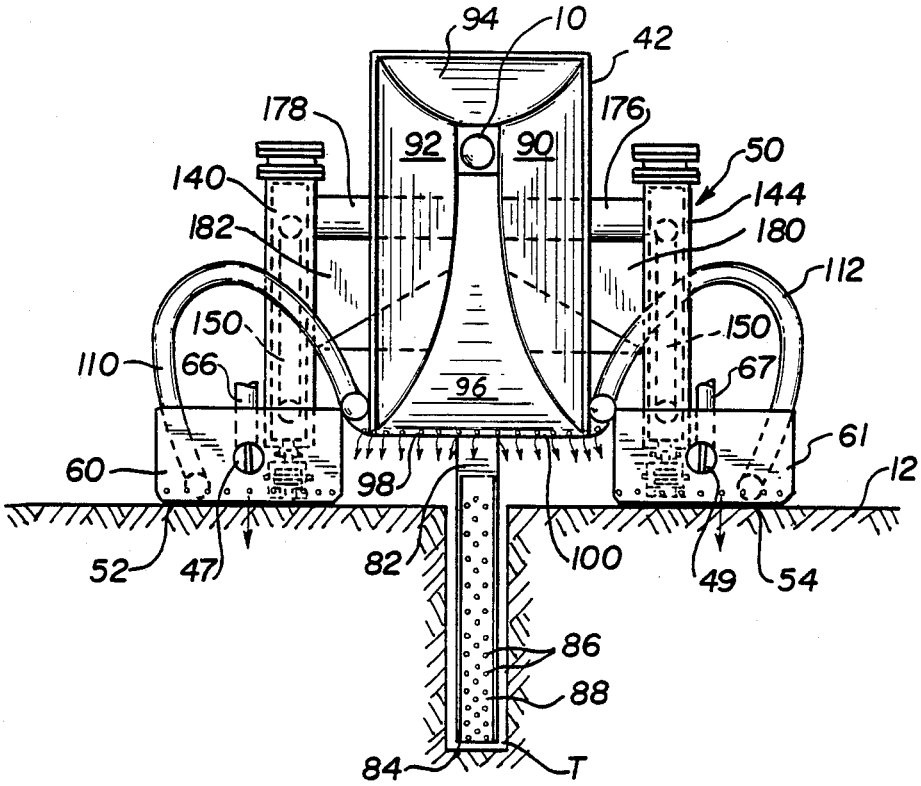
FIG. 3 is a front elevational view of the embedder of the present invention, showing the nozzles in the depressor or pedestal of the cable guide member without the rotary saw.
Figure 4:
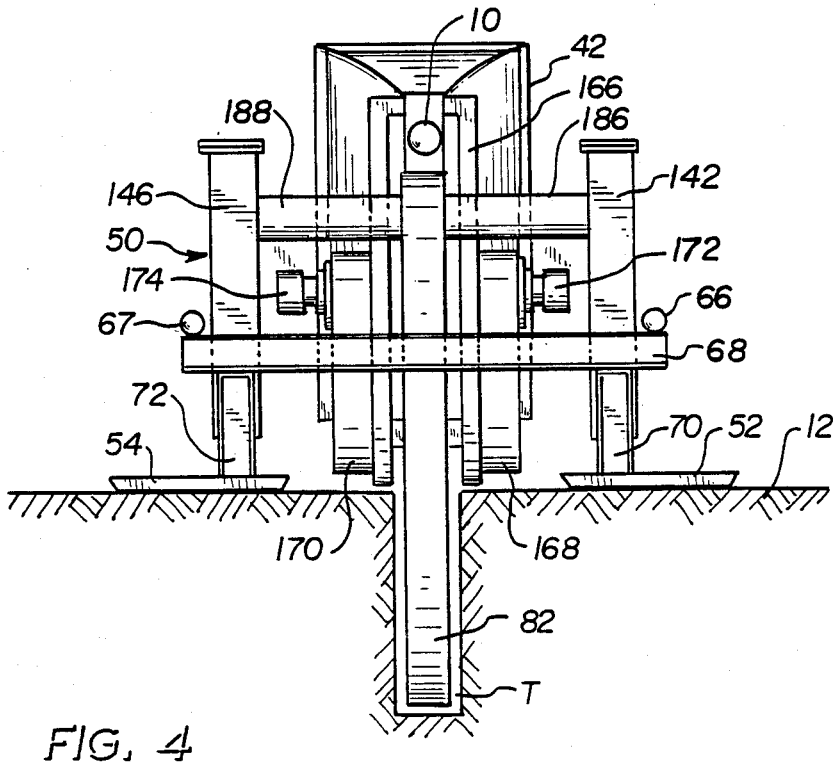
FIG. 4 is a rear view illustrating the drive for the cable embedder without the eductor system.

FIGS. 2 through 10 more clearly illustrate several other components of cable embedder assembly 20. A substantially rectangular framework generally designated at 50 in FIGS. 2, 3 and 4 supports and positions rotary saw 40 and cable guide member 42 into and out of trench T through means which will be discussed in detail hereinafter. A framework generally numbered at 50 is mounted on two spaced apart runners 52, 54 shown best in FIGS. 2, 3, and 4, with runner 52 best shown in FIG. 2. Runners 52, 54 are, in effect, skids having downwardly sloped side walls and relatively flat top and bottom surfaces (FIG. 4). Runners 52, 54 are spaced parallel relative to each other and straddle rotary saw 40 and cable guide member 42 which are mounted therebetween.

As shown in FIG. 2, a front portion of runner 52 extends upwardly in an inclined manner to form a sled. This front sled portion of runner 52 consists of a plate member 60 welded to a manifold pipe 62 and a brace member 64 welded to plate 60 and a top surface of runner 52. Runner 54 has a similar sled in front which only shows its plate 61 in FIG. 3. Even though not shown, the sled of runner 54 has a manifold pipe similar to manifold pipe 62, and for clarity manifold pipe 62 is only shown in FIG. 2.

Manifold pipe 62 of runner 52 and that of runner 54 are, in turn, welded to runners 52, 54 and in the form shown comprise a row of nine jet spray nozzles indicated at 65 in FIG. 2 and the flow is indicated by an arrow directed out of plates 60, 61 of the runners 52 and 54, as shown in FIG. 3. The nozzles 65 are replaceable units having a flow passage diameter which may be approximately $\frac{3}{8}$ inch. The flow axis of nozzles 65 is about 45° with respect to the plane of the base of runners 52 and 54.

In referring to FIG. 3, the eductor system 46 consists of an eductor pipe 66, 67 whose intake end 47, 49 communicates with plates 60, 61. As particularly shown in FIG. 2 eductor pipe 66 is mounted through means such as welding to the front sled portion of runner 52. Eductor pipe 66 extends in an upwardly sloping fashion away from the intake end 47, in a longitudinal direction parallel to runner 52, and then in a downwardly sloping fashion terminating in discharge end 48. Eductor pipe 67 associated with runner 54 is mounted and is constructed similar to eductor pipe 66.

Still referring to FIG. 2, at the rear of cable embedder 20, eductor pipe 66 is supported by an I-beam 68. Beam 68 extends transversely across the embedder 20 where as shown in FIG. 4, I-beam 68 is supported, in turn, by structural support members 70, 72 mounted through suitable means, such as welding, on runners 52, 54 respectively. Support members 70, 72 are braced to runners 52 and 54 by a brace member shown only at 74 in FIG. 2. Even though not shown in the figures, eductor pipe 67 is also supported by I-beam 68.

Figure 6:
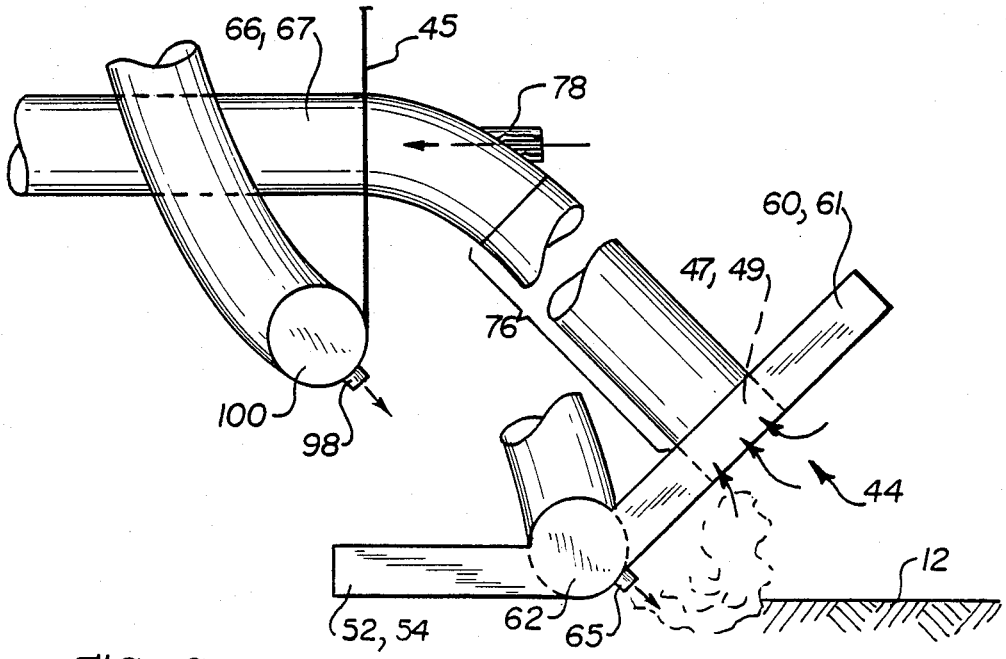
FIG. 6 is a diagrammatic view showing the jet flows and the suction flows of the sand overburden and/or rock into the eductor system.

Each eductor pipe 66, 67 has as mentioned hereinbefore a suction or intake end 47, 49 in plate 60, 61 of runners 52, 54 as best seen in FIGS. 3 and 6. The suctioning action is schematically shown in this FIG. 6 where a suction area is generally that area indicated by the bracket bearing number 76. As best shown in FIG. 6, connected to and communicating with a top portion of each eductor pipe 66, 67 is a pipe bearing numer 78 in FIG. 6, which delivers water from pipeline 36 of pump units 28 into the top of eductor pipe 66, 67 at a sufficient pressure, volume, and velocity that a negative pressure or suctioning action is created near the bottom portion of the eductor pipe 66, 67 in the general area designated as 76 in FIG. 6.

The negative pressure acts as a water vacuum to pick up the slurry created by the fluidization or liquification of the soil and/or rock cuttings. For example, water may be delivered in each water pipe such as indicated at 78 in FIG. 6 at approximately 250 p.s.i. to 260 p.s.i. at approximately 1600 to 1800 gallons per minute at a velocity of 180 miles per hour to move 21.2 cubic feet per minute of slurry each 47.1 yards per hour.

Eductor pipes 66 and 67 measure approximately between 6 and 8 inches in diameter, and pipe 78 as well as a similar pipe (not shown) in eductor pipe 67 is approximately $1\frac{1}{2}$ inches in diameter. Eductor pipes 66 and 67 and the inlet pipes 78 of the eductor system 46 of runners 52 and 54 are made of mild steel.

Referring to FIGS. 2 and 3 and as best seen in FIG. 2, cable guide member 42 has a bellmouth or flared mouth entry 45. From entry 45 and as shown in FIG. 3, cable guide member 42 extends longitudinally and curves around rotary saw 40 to form a flared depressor or pedestal 82 for discharging cable 10. Even though not fully shown, it is appreciated that the bellmouth 45 has a greater width than that of pedestal 82, which width gradually tapers from bellmouth 45 to pedestal 82. Fairing may be provided at the mouth and discharge end of the cable guide 42 to protect the cable 10. As is well-known in the art, the water in the cable guide member 42 aids in protecting the cable 10 against abrasive particles or objects. Depressor or pedestal 82 functions in cooperation with rotary saw 40 to form trench T, more about which will be discussed hereinafter. Depressor 82 extends down beyond the outer periphery of rotary saw 40 and broadens out along its undersurface to support and stabilize the cable embedder assembly 20 particularly during the trenching operation.

Rotary saw 40 preferably measures approximately ten feet in diameter and 10 inches in width and is mounted on framework 50 to dig in rock layer 12 a trench T approximately four feet in depth and approximately 10 inches wide.

Among the suitable forms of rotary saw 40 are those available from Tesmec, Jetco, or Vermeer. Preferably rotary saw 40 contains a plurality of tungsten-carbide members such as those shown in FIG. 9, and one of which is indicated at 83. It is to be appreciated that such members 83 are mounted so that the tips dig into the rock layer 12 in the direction shown by the arrow in FIGS. 2 and 9.

As clearly seen in FIG. 2, pedestal 82 of cable guide member 42 has a cutting or ripping portion 84 on its bottom forward wall adjacent to rotary saw 40, which portion 84 works as a knife and cooperates with rotary saw 40 to cut into the waterbed, particularly the rock layer 12 in forming trench T. In referring to FIG. 3, preferably the width of pedestal 82 is substantially the same as or less than that of rotary saw 40 so that it can fit down into the trench T basically cut out by rotary saw 40. Preferably this width of pedestal is $8\frac{1}{2}$ inches. Along this inward longitudinal wall of pedestal 82 upwardly from ripping portion 84 are three rows of nozzles as seen in FIG. 3, and one of which is indicated at 86 in FIG. 2. These several nozzles 86 communicate with a manifold pipe 88 mounted by suitable means in pedestal 82 and connected through water lines 32 and 34 to pump units 24 and 26, respectively.

Nozzles 86 may be similar to nozzles 65 of manifold pipes 62 of runners 52 and 54, and are replaceable units with a $\frac{3}{8}$ inch or less diameter flow passage. Their flow axis is directed into the direction of rotary saw 40 to cooperate with rotary saw 40 and ripping portion 84 of pedestal 82 to cut through the rock layer 12 and to direct the slurry in the direction of the rotation of rotary saw 40 toward the front of embedder assembly 20 for its conveyance to the back of the embedder 20 by the eductor system 46.

As best seen in FIG. 3, bellmouth 45 of cable guide member 42, receives cable 10 and has an entrance and a radius formed by inner sloping side walls 90 and 92, top wall 94 and bottom wall 96. The radius of bellmouth 45 is designed such as to prevent sharp bends in the cable 10 as it is being laid along the waterbed. Cable 10 can be laid or picked up by embedder 20 due to the radius of bellmouth 45.

As seen in FIGS. 2, 3 and 6 and as best seen in FIGS. 3 and 6, bellmouth 45 of cable guide member 42 has a plurality of jet spray nozzles, one of which is indicated at 98 extending substantially across the bottom front of bellmouth 45. Nozzles 98 may be similar to the nozzles of sleds 56, 58 and pedestal 82. The pressure and volume of the flow rate of these nozzles 98 may be 120 p.s.i. at 1600 gallons per minute and are connected as are nozzles 65 of runners 52, 54 and nozzles 86 of pedestal 82 by water lines 32 and 34 to pump units 24 and 26, respectively. These nozzles 98 are serviced by a manifold pipe 100 welded into the wall 96 of bellmouth 45. FIG. 2 shows the outlet of nozzles 98 as being substantially directed in a downward direction to the outlet of nozzles 65 of runners 52, 54 which as seen in FIG. 3 are located on opposite sides of bellmouth 45. The flow axis of these several nozzles 65 and 98 of runners 52, 54 and bellmouth 45 respectively deliver a waterflow such that the sand overburden and/or the rock cuttings, which may otherwise adhere to the front of embedder 20 are forced away from the surfaces of embedder 20 to be suctioned in by eductor pipes 66, 67 on runners 52, 54.

The nozzles 65, 86, and 98 on components 45, 52, 54, and 82 disturb and fluidize the sand overburden encountered along the path of embedder 20 so that the eductor pipes 66 and 67 will pick the slurry up and deposit it from discharge end 48 to the rear of embedder 10 back into trench T.

Referring particularly to FIGS. 2 and 3, manifold pipes 62 of runners 52, 54 communicate with manifold pipe 100 of bellmouth 45 by a flexible hose connection 110, 112, respectively. Flexible hose connections 110 and 112 are also connected to water line 32 and 34 and pump unit 24 and 26, respectively, to deliver the same volume and pressure water supply thereto as that of the nozzles 86 of pedestal 82 of cable guide member 42.

Figure 10:
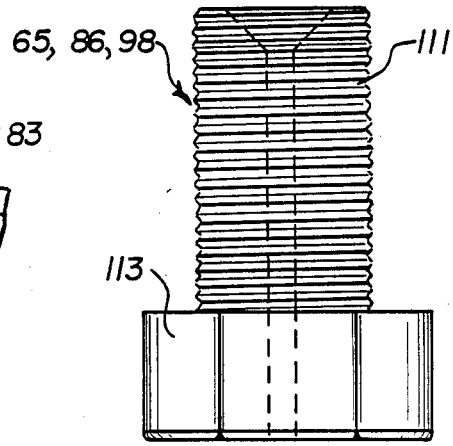
FIG. 10 is a detail view of one of the spray nozzles of the embedder of the present invention.

FIG. 10 shows a typical design of a nozzle for nozzles 65, 86, and 98, which has a water inlet end 111 and a nozzle member 113 fastened by means (not shown) to water inlet end 111 to deliver the water flow as described hereinabove.

In FIG. 3 it can be seen that bellmouth 45 and rotary saw 40 are disposed between runners 52 and 54 and through framework 50 which is to be discussed more fully herein and are positioned therebetween at various elevational levels into and out of trench T dug out of rock layer 12.

As is apparent in FIGS. 1–4, pedestal 82 of cable guide member 42 and rotary saw 40 (not shown) are in their disposition in trench T. In view of the structure of framework 50, both cable guide member 42 and rotary saw 40 are raised with pedestal 82 and saw 40 out of trench T in waterbed 14 with their bottoms approximately at the same level as runners 52, 54 whereas runners 52, 54 with eductor pipes 66, 67 remain on top of rock layer 12. The flexible hose connections 110 and 112 permit this relative movement of cable guide member 42 relative to runners 52, 54 without disconnecting pipes 62 and 100 of fluidization system 44.

Preferably, the positioning of the tops of bellmouth 45 and rotary saw 40 above framework 50 in waterbed 14 is for embedding cable 10 along the bottom of waterbed 14, and their positioning down into trench T as shown in the figures is for embedding cable 10 in rock layer 12.

Referring particularly to FIG. 2, framework 50 is mounted for pivotal movement relative to runners 52, 54 by a hinge assembly 114 and a hinge-roller assembly 116. Hinge assembly 114 is located at the front of embedder 20 assembly and consists of a member 118 welded directly on a T-shaped slider 120 of runners 52, 54 and a hinge 122.mounted at the bottom of framework 50.

Figure 7:
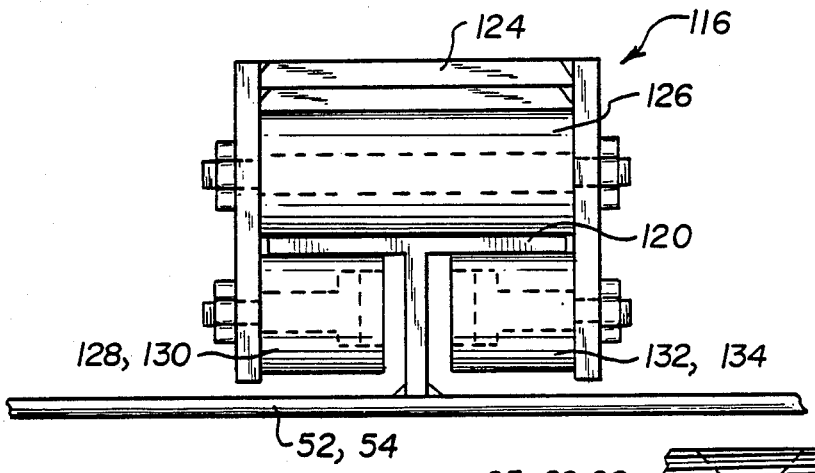
FIG. 7 is an enlarged detail front view of the roller assembly and its mounting on the sled of the embedder of the present invention.
Figure 9:
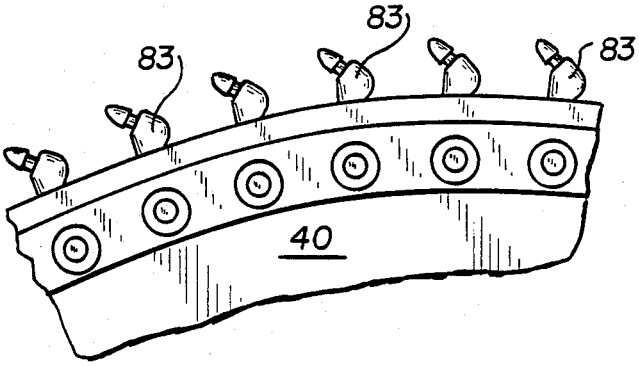
FIG. 9 is a segmental side view showing in detail teeth on the rotary saw of the embedder of the present invention.
Figure 8:
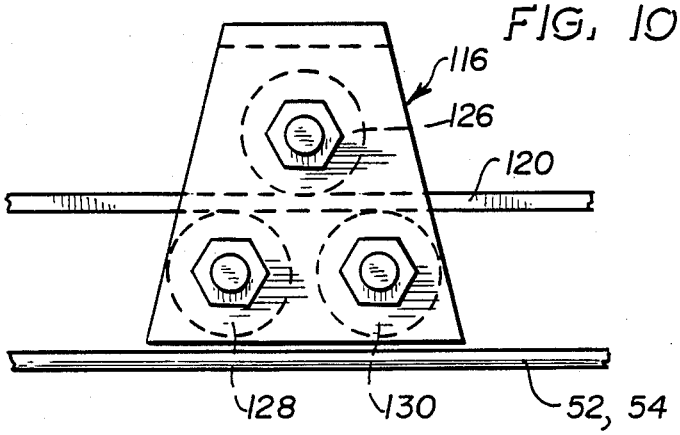
FIG. 8 is an enlarged, detail side view of the roller assembly of FIG. 7.

Hinge-roller assembly 116 is mounted at the rear of cable embedded assembly 20 on runners 52, 54 by means of T-shaped slider member 120 as particularly shown in FIG. 3, 7, and 8. Hinge-roller assembly 116 has a roller assembly with an inverted U-shaped housing element 124 and several rollers 126, 128, 130, 132, and 134 shown in FIGS. 7 and 8. Top roller 126 has a shaft extending through the width of housing 124, and bottom rollers 128–134 have a stud axle mounted in housing 124 as shown in FIG. 7. The surfaces of these rollers 126–134 engage the bottom and top surfaces of T-shaped slider 120 of runners 52, 54.

As can be seen in FIG. 2, the hinge of hinge-roller assembly 116 is mounted to the top of housing 124 of the roller assembly by a member 136 and a hinge located at the bottom of framework 50.

This type of mounting of framework 50 on runners 52, 54 allow for easy movement thereof, particularly in the trench digging operation which will become more apparent hereinafter.

Referring again to FIGS. 2, 3 and 4, framework 50 comprises several hydraulic posts 140, 142, 144 and 146. Posts 140 and 144 are connected to runners 52, 54 by hinge assembly 114, and back posts 142, 146 are connected to runners 52, 54 by hinge-roller assembly 116.

Figure 5:
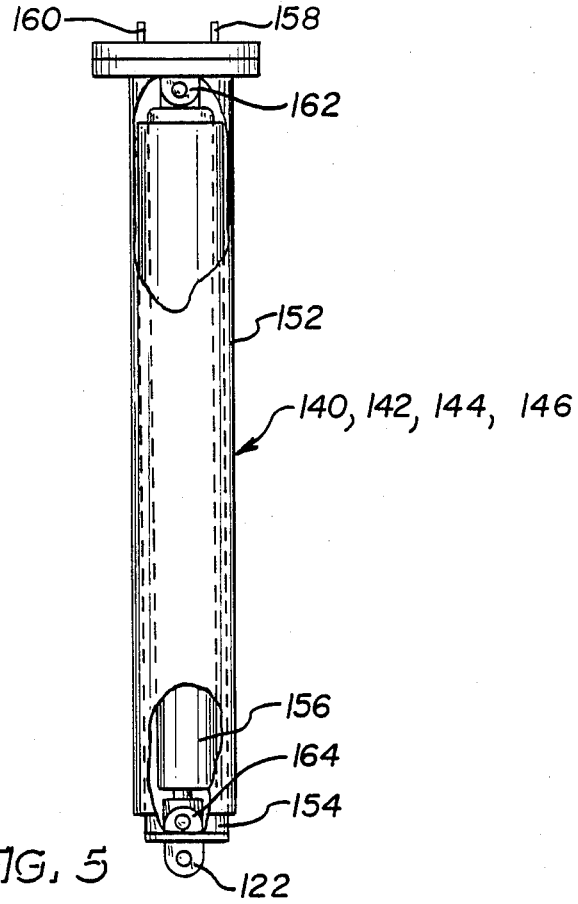
FIG. 5 is an enlarged detailed view of one of the hydraulic devices in the frame of the embedder of the present invention, which view is partly broken away to show the inside of the hydraulic device.

The construction of each posts 140, 142, 144 and 146 is best illustrated in FIG. 5. Posts 140, 142, 144 and 146 have an outer pipe leg 152 and an inner pipe leg 154, whereby outer pipe leg is raised and lowered relative to inner pipe leg 154 by a hydraulic piston cylinder assembly 156 which receives its supply through hydraulic lines 158, 160 located at the top of outer leg 152, which lines 158 and 160 are connected to an appropriate hydraulic power source (not shown) located on barge 18. As seen in this FIG. 5, hydraulic piston cylinder assembly 156 is attached to the top and bottom of inner leg 154 through connections 162, 164 respectively. Each post 140–146 is connected to either the hinge-roller assembly 116 or to the hinge assembly 114 by a hinge 122 (FIG. 2). Preferably, outer leg 152 is approximately a nine inch pipe and inner leg 154 is approximately an eight inch pipe.

Cable guide member 42 and rotary saw 40 are connected together to be raised and lowered through operation of hydraulic posts 140, 142, 144 and 146 in a manner shown and which is to be explained with reference to FIGS. 2, 3 and 4. A boom assembly 166 is connected through suitable means to cable guide member 42. Boom assembly 166 supports gear cases 168, 170 which are operated by hydraulic motors 172, 174 respectively to drive rotary saw 40. Hydraulic motors 172, 174 are connected to hydraulic power source 30 on barge 18 (FIG. 1) through supply lines 38.

As particularly shown in FIG. 3, cross members 176 and 178 are gusset plates 180 and 182 connect the front end of cable guide member 42 to the outer leg 152 of posts 140 and 144. An additional gusset plate, one of which is indicated at 184 and located near the top of post 140 in FIG. 2 is provided on opposite sides of bellmouth 45 to add stability thereto. The rear end of cable guide member 42 is connected to the outer leg 152 of posts 142 and 146 through cross members 186 and 188 as shown in FIG. 4. Even though not shown in this figure, gusset plates indicated at 190 and 192 are provided on either side of cable guide member 42 to stabilize and support cable member 42 and rotary saw 40 on framework 50.

In operation, cable embedder assembly 20 is disposed in waterbed 14 on rock layer 12 with runners 52, 54 being supported on rock layer 12. Both cable guide member 42 and rotary saw 40 are initially positioned such that preferably the bottom of pedestal 82 is in line with runners 52, 54.

Rotary saw 40 can be used to dig down into rock layer 12 to start to form or to form a trench the desired depth. If cable 10 is to be embedded only in the sand overburden of waterbed 14, rotary saw 40 and cable guide member 42 are lowered to a desired depth in the formed trench T.

The towing operation of embedder assembly 20 relative to barge 18 is well known in the art where as barge 18 is moved a distance, embedder 20 is dragged behind it. As embedder 20 is towed by tow line 22 on barge 18, preferably the front nozzles 65 and 98 of runners 52, 54, and bellmouth 45 and the eductor system 46 are not being operated. During this embedding operation, preferably rotary saw 40 is being operated in order to reduce frictional drag. Preferably, rotary saw 40 is always being operated regardless of whether cable 10 is embedded in the sand overburden or in rock layer 12 in order to reduce frictional drag.

If cable 10 is to be buried or embedded in the rock layer 12, a trenching operation is performed. Rotary saw 40 and cable guide member 42 initially are raised in the position where the bottom of pedestal 82 is in the line with runners 52, 54 which are resting on top of rock layer 12 and the bottom of rotary saw 40 is slightly raised above the bottom of pedestal 82.

As cable embedder assemble 20 is pulled along the waterbed, rotary saw 40 is being operated to cut through rock layer 12. The several nozzles 65, 98, and 86 of runners 52, 54, of bellmouth 45, and of pedestal 82 are operated along with water being supplied to eductor pipes 66, 67 to first fluidize the sand overburden and rock cuttings and at the same time pick up and convey these earthen materials to the rear of cable embedder assembly 20 where the slurry is discharged behind embedder 20 and placed back into the burrowed trench T. In the initial trenchmaking operation, the hydraulic piston cylinder assemblies or devices in posts 140, 142, 144, and 146 of framework 50 are operated to ease the front of bellmouth 45 and rotary saw 40 along a gentle slope down into rock layer 14 where a cutting action from rotary saw 40 is generated. In this step both bellmouth 45 and rotary saw 40 are able to move relative to runners 52, 54 by hinge assembly 114 and hinge-roller assembly 116 which allow for the downward and forward movement of rotary saw 40 in the initial forming of trench T. Pedestal 82 of cable guide member 142 follows the rotary saw 40 down into trench T until the desired depth is reached. With pedestal 82 and rotary saw 40 in the trench T, embedder assembly 20 continues to be pulled by towing line 22 to form a continuous trench along the waterbed where cable 10 is continually being dispensed and laid therein. Upon laying of cable 10, the earthen materials previously removed in making trench T are constantly being backfilled to bury the cable 10 in trench T. To remove cable embedder assembly 20 from trench T the hydraulic devices in posts 140–146 are operated to raise rotary saw 40 and pedestal 82 out of the trench T in an obvious manner.

All of the foregoing has been accomplished in such a fashion as to permit an economical manufacturing of a cable embedding device with an increased mobility due to its compactness and an increased versatility in that it can be used in laying cable on top of and down into solid rock.

While for convenience of illustration, the framework 50 supports the cable guide member 42 and rotary saw 40 on both its sides, it will be appreciated that support if desired can be provided only on one side. Also, it will be appreciated that if desired only one runner 52, 54 can be provided. Furthermore, the cable embedding assembly 20 can be used other than in water on any solid foundation for its support.

Whereas a particular embodiment of the invention has been described above for purposes of illustration, it will be evident to those skilled in the art that numerous variations of the details may be made without departing from the invention as defined in the appended claims.

I claim:

1. An apparatus for embedding a cable-like member under water, comprising:

a waterbed contacting support assembly having a front end, means mounted on said support assembly for receiving and guiding said cable-like member along said waterbed, a system of spray nozzle means located on said front end of said support assembly for creating spray flows at a sufficient flow rate and positive pressure of fluidize into a slurray at least the sand overburden of said waterbed in the path of said apparatus, eductor means supported by said waterbed contacting support assembly and said front end of said support assembly and extending longitudinally relative to and behind said apparatus, and including means for creating a negative pressure in said eductor means for picking up, carrying, and discharging said slurry in said path immediately behind said apparatus to embed said cable-like member, said eductor means further including intake means located in said front end of said support assembly in close proximity to said system of spray nozzle means, and being cooperatively operable with said system of spray nozzle means for directly removing said slurry from in front of said apparatus to substantially clear said path for relative ease of movement of said apparatus in said waterbed, fluid supply means for providing water under pressure and connected to said system of spray nozzle means and said eductor means for creating said positive and negative pressure therein.

2. An apparatus of claim 1, wherein said waterbed contacting support assembly comprises two spaced apart parallel runners each with a said front end including a front sled portion, and wherein said spray nozzle means and said intake means of said eductor means are carried by runner.

3. An apparatus of claim 2, wherein said eductor means includes an eductor pipe associated with each said runner, wherein said support assembly further comprises a support member mounted on said each runner toward the rear of said waterbed contacting support assembly and a traverse brace member supported by said support members, and wherein said eductor pipe of each said runner is supported by said traverse brace member, and wherein said each eductor pipe has a said intake means, and a discharge end disposed at an angle into the path made by said embedding apparatus such that said slurry is backfilled into said path for embedding said cable-like member.

4. An apparatus of claim 1, wherein said eductor means further has a discharge end, and further extends upwardly away from said front end of said support assembly, longitudinally along the length of said support assembly, and said discharge end extends downwardly therefrom into said path behind said apparatus, and wherein said eductor means is further adapted and disposed on said waterbed contacting support assembly so as to be positioned in said waterbed relatively in close proximity to or in said sand overburden generally for the embedding operation of said cable-like member.

5. An apparatus of claim 1, wherein said fluid supply means for creating said negative pressure includes pipe means communicating with said eductor means and extending longitudinally relative to said eductor means thereby creating said negative pressure in a front section of said eductor means and in said front end of said waterbed contacting assembly.

6. An apparatus of claim 1, wherein said means for receiving and guiding said cable-like member comprises a bellmouth and includes spray nozzle means arranged along the front of said bellmouth in cooperation with said spray nozzle means of said waterbed contacting support assembly for making said slurry.

7. An apparatus of claim 6, wherein said fluid supply means comprises a manifold pipe extending along a bottom of said front end of said support assembly, and a manifold pipe extending along said front of said bellmouth in communication with said spray nozzle means thereof, and flexible conduit means interconnecting said manifold pipes.

8. An apparatus of claim 1, wherein said fluid supply means for creating said negative pressure in said eductor means includes means for supplying said water under a pressure ranging between 250 p.s.i. and 260 p.s.i. and a flow rate ranging between 1600 and 1800 gallons per minute.

9. An apparatus of claim 1, wherein said waterbed contacting support assembly comprises two spaced-apart parallel runners each with an open front sled portion, in which a part of said system of spray nozzles is located, and wherein said means for receiving and guiding said cable-like member is mounted between said runners and contains the remaining part of said system of spray nozzle means which cooperate with those of said runners for said fluidization of said sand overburden.

10. An apparatus for embedding a cable-like member under water and for making a trench in the rock layer of the waterbed, comprising:

means for receiving and guiding said cable-like member down into said waterbed, cutting means for cutting through said rock layer of said waterbed for making said trench, a waterbed contacting support assembly, framework means mounted on said contacting support assembly for supporting said means for receiving and guiding said cable-like member and said cutting means as a unit, said framework means having a plurality of upright posts and a plurality of members for interconnecting said posts and for connecting said means for receiving and guiding said cable-like member and said cutting means to said framework, and said posts each including hydraulic means for disposing said means for receiving and guiding said cable-like member and said cutting means together as a unit in various elevational levels and into and out of said trench.

11. An apparatus of claim 10, wherein said hydraulic means of said each posts comprises an outer pipe means and an inner pipe means, each arranged such that said pipe means is moved relative to each other, hydraulic piston cylinder assembly mounted in said inner pipe means, supply means for providing hydraulic fluid under pressure to said each posts, and control means for independently operating and controlling said hydraulic means of said each upright posts.

12. An apparatus of claim 10, wherein said plurality of posts consists of a pair of rear posts and a pair of front posts, wherein said rock cutting means has a horizontal axis, and wherein said waterbed contacting support assembly includes a pair of spaced-apart runners extending generally parallel to said horizontal axis of said rock cutting means between which said means for receiving and guiding said cable-like member and said rock cutting means are mounted and on which one of said front and rear posts are mounted.

13. An apparatus of claim 12, further comprising hinge means for pivotally mounting said pair of front upright posts on the front of each said runner and a hinge-roller assembly means for mounting said pair of rear upright posts on the rear of each said runner.

14. An apparatus of claim 13, wherein said each runner comprises a generally T-shaped slider member, and wherein said hinge-roller assembly includes a plurality of roller means engaging the surfaces of said generally T-shaped member for movement of said rear upright posts thereon.

15. An apparatus of claim 14, wherein said roller assembly means further includes a housing element for mounting said roller means and through which said generally T-shaped member extends, and wherein said plurality of roller means consists of a top roller and a plurality of bottom rollers offsetting said top roller and arranged to contact opposite surfaces of said T-shaped slider member.

16. An apparatus of claim 14, wherein said hinge means of said pair of front posts are mounted on said T-shaped slider member.

17. An apparatus for embedding a cable-like member under water and for making a trench in the rock layer of the waterbed, comprising:

means for receiving and guiding said cable-like member down into said waterbed, cutting means for cutting through said rock layer, a waterbed contacting support assembly, framework means mounted on said contacting support assembly for supporting said cable receiving and guiding means and said rock cutting means together as a unit, said framework means including a plurality of hydraulically operated upright post means for disposing said cable receiving and guiding means and said cutting means together as a unit in various elevational levels relative to said waterbed and said trench, and means for mounting said framework means including hinge means pivotally connecting said upright post means located to the front of said contacting support assembly, and roller assembly means associated with said upright post means located to the rear of said contacting support assembly.

18. An apparatus of claim 17, further comprising a hinge member connected to the bottom of said rear upright post means and to said roller assembly means.

19. An apparatus of claim 18, wherein said water contacting support assembly further comprises runner means having a generally T-shaped slider member in cross section, and wherein said roller assembly means comprises a plurality of roller means engaging the surfaces of said T-shaped member for movement of said framework along said runner means.

20. An apparatus of claim 19, wherein said roller assembly means further comprises a housing element for mounting said roller assembly means and through which said generally T-shaped slider member extends, and said plurality of roller means consists of a top roller and a plurality of bottom rollers offsetting said top roller and arranged to contact opposite surfaces of said T-shaped slider member.

21. An apparatus for embedding a cable-like member under water along the waterbed or along a trench formed in the rock layer beneath said waterbed by said apparatus, comprising:

a member for receiving and guiding said cable-like member, a rotary driven cutting means for cutting through said rock layer in forming said trench, a waterbed contacting support assembly, framework means mounted on said contacting support assembly for supporting said cable receiving and guiding member and said cutting means as a unit, said framework means including a plurality of hydraulically operated upright post means for disposing said cable receiving and guiding member and said cutting means in various elevational levels relative to sand waterbed and said trench for forming thereof, a system of spray nozzle means located at least along a front end of said support assembly for creating a spray at a sufficient flow rate and positive pressure to fluidize in the path of said apparatus the sand overburden of said waterbed and the rock cutting made by said cutting means into a slurry, eductor means connected to and communicating with said front of said support assembly and extending longitudinally relative to said support assembly and behind said cable receiving and guiding member, including means for creating a negative pressure for picking up, transporting, and discharging said slurry into said formed trench immediately behind said cable embedding apparatus for embedding said cable therein, and fluid supply means for providing fluid under pressure and connected to said system of spray nozzle means and to said eductor means for creating said positive and negative pressures therein.

22. An apparatus of claim 21, wherein said cable receiving and guiding member has a bellmouth with a radius entrance, a tapering portion extending longitudinally and downwardly in a curved manner and a flared discharge end, said discharge end having a pedestal with a width substantially the same as said cutting means and adapted to be disposed into said trench and to partially support said cable receiving and guiding member at least during said trench forming operation.

23. An apparatus of claim 22, wherein said pedestal has a sharp inner edge portion adjacent to said rotary driven cutting means for digging into said waterbed and said trench.

24. An apparatus of claim 22, wherein said longitudinal and downwardly extending portion of said cable receiving and guiding member comprises a plurality of spray nozzle means along a forward wall of said pedestal adjacent to said cutting means for creating a spray flow to fluidize and force at least the cuttings of said rock cutting means in a forward direction.

25. An apparatus of claim 24, further comprising manifold means for supplying fluid under pressure to said spray nozzle means of said pedestal, and connected to said fluid supply means.

26. An apparatus of claim 21, wherein said cable receiving and guiding member has a bellmouth with a radius and flared entrance and includes spray nozzle means disposed along a bottom portion of said flared entrance and adapted to be operated to cooperate with those spray nozzle means of said waterbed contacting support assembly in said fluidization of said sand overburden and said rock cuttings during said trench forming operation, and further including flexible conduit means interconnecting said spray nozzle means of said bellmuth and those of said contacting assembly.

27. An apparatus of claim 26, wherein said fluid supply means comprises a manifold pipe extending along said bellmouth in communication with said spray nozzle means along said bottom portion thereof, and a manifold pipe extending along a front end of said support assembly in communication with said spray nozzle means thereof.

28. An apparatus of claim 21, wherein said apparatus is adapted to be towed along or in said waterbed by a barge, and wherein said fluid supply source of pressurized fluid for said hydraulic means of said framework means and for said spray nozzle means is located on said barge.

29. An apparatus of claim 21, wherein said water contacting support assembly comprises two generally spaced-apart parallel runners each with a front sled portion, wherein said spray nozzle means are mounted in and said eductor means are in communication with said front sled portion of said each runners, and wherein said cable receiving and guiding member and said rock cutting means are mounted to said framework means between said spaced-apart runners.

30. An apparatus of claim 29, wherein said each runner is adapted to remain along said waterbed on said rock layer during said trench forming operation, and wherein said rock cutting means is adapted to be selectively operated and lowered for said trench forming operation.

31. An apparatus of claim 29, wherein said plurality of upright post means comprises a pair of front posts, one being mounted at the front of each said runner, and a pair of rear posts, one being mounted at the rear of each said runner, and wherein said framework means further comprises a plurality of members interconnecting said posts and for connecting said cable receiving and guiding member and said cutting means to said framework means.

32. An apparatus of claim 31, wherein said mounting of said front posts consists of a hinge assembly and said mounting of said rear posts consists of a hinge-roller assembly means.

33. An apparatus of claim 32, wherein said each runner has a generally T-shaped slider in cross section, and wherein said hinge-roller assembly means comprises a plurality of roller means engaging the surfaces of said slider for relative movement between said framework means and said contacting support assembly.

34. An apparatus of claim 33, wherein said roller assembly means further comprises a housing element for mounting said roller means and through which said slider extends, and said plurality of roller means consists of a top roller and a plurality of bottom rollers offsetting said top roller and arranged to contact opposite sides of said T-shaped slider member.

35. An apparatus of claim 21, wherein said eductor means includes an eductor pipe on opposite longitudinal sides of said support assembly, and are supported by support members located at the rear of said water contacting support assembly, and wherein said each eductor pipe has an entry end and a discharge end and said discharge end is disposed at a downward angle of 45° into the trench made by said embedding apparatus for discharging said slurry therein.

36. An apparatus of claim 35, wherein said fluid supply means for creating said negative pressure in said eductor means includes means for supplying said fluid into a top portion of said each eductor pipe under a pressure ranging between 250 and 260 p.s.i. and a flow rate ranging between 1600 and 1800 gallons per minute, whereby said negative pressure is created in the front of each said eductor pipe in communication with said front of said waterbed contacting support assembly.

37. A method of forming a trench for laying and embedding cable in a waterbed, having a rock layer and sand overburden layer, the steps comprising:

providing a cable embedder with a waterbed contacting support assembly on said rock layer and having framework means for supporting a cable receiving and guiding means and rock cutting means together as a unit, operating said rock cutting means to dig into said rock layer providing a plurality of spray nozzles on the front of said support assembly and said cable receiving and guiding member whose flow cooperates to fluidize the sand overburden and rock cuttings into a slurry, picking up said slurry, conveying it along and discharging it immediately behind said contacting support assembly into the dug out portion of said rock layer, in forming said trench, hydraulically operating and allowing movement of said framework means on said contacting support assembly in such a manner that the front of said cable receiving and guiding means and said cutting means is progressively eased as a unit down into the trench being formed until the desired depth of said trench is reached at which time the bottom portions of said cable receiving and guiding means which dispenses the cable and said cutting means are in said trench and said water contacting support assembly still rests on said rock layer, and pulling said water contacting support assembly while continually operating said cutting means to form said trench, fluidizing said rock cuttings, and discharging said slurry back into said formed trench behind said support assembly for said embedding of said cable.

38. A method of claim 37, the steps further comprising:

hydraulically operating said framework means to raise said cable receiving and guiding means and said rock cutting means saw as a unit out of said trench to travel with said contacting support assembly along said waterbed, and selectively fluidizing said sand overburden of said waterbed into said slurry, picking said slurry up, and discharging it behind said contacting support assembly back into the path of travel of said cable embedder to embed said cable, and said selectively fluidizing and discharging steps being performed prior to and/or after said trenchmaking operation.

39. An apparatus for embedding a cable-like member under water, comprising:

a waterbed contacting support assembly, means mounted on said support assembly for receiving and guiding said cable-like member along said waterbed, a system of spray nozzle means located along a front end of said support assembly for creating spray flows at a sufficient flow rate and positive pressure to fluidize at least the sand overburden of said waterbed in the path of said apparatus into a slurry, eductor means connected to and communicating with said front end of said support assembly and extending longitudinally relative to and behind said apparatus and including means for creating a negative pressure for picking up, carrying, and discharging said slurry in said path immediately behind said apparatus to embed said cable-like member, and fluid supply means for providing fluid under pressure connected to said system of spray nozzle means and said eductor means for creating said positive and negative pressures therein, said waterbed contacting support assembly further comprising two spaced apart parallel runners each with a front sled portion, said spray nozzle means being mounted in and said eductor means being in communication with said front sled portion of said each runner, said eductor means further including an eductor pipe associated with each said runner, said support assembly further comprising a support member mounted on said each runner toward the rear of said waterbed contacting support assembly and a traverse brace member supported by said support members, said eductor pipe of each said runner being supported by said traverse brace member, and said each eductor pipe having an entry end in said communication with said front sled portion and a discharge end being disposed at an angle into the path made by said embedding apparatus such that said slurry is backfilled into said path for embedding said cable-like member.

40. An apparatus for embedding a cable-like member under water, comprising:

a waterbed contacting support assembly, means mounted on said support assembly for receiving and guiding said cable-like member along said waterbed, a system of spray nozzle means located along a front end of said support assembly for creating spray flows at a sufficient flow rate and positive pressure to fluidize at least the sand overburden of said waterbed in the path of said apparatus into a slurry, eductor means connected to and communicating with said front end of said support assembly and extending longitudinally relative to and behind said apparatus and including means for creating a negative pressure for picking up, carrying, and discharging said slurry in said path immediately behind said apparatus to embed said cable-like member, and fluid supply means for providing fluid under pressure connected to said system of spray nozzle means and said eductor means for creating said positive and negative pressures therein, said means for receiving and guiding said cable-like member comprising a bellmouth and including spray nozzle means arranged along the front of said bellmouth in cooperation with said spray nozzle means of said waterbed contacting support assembly for making said slurry.

said fluid supply means comprising a manifold pipe extending along a bottom of said front end of said support assembly, and a manifold pipe extending along said front of said bellmouth in communication with said spray nozzle means thereof, and flexible conduit means interconnecting said manifold pipes.

* * * * *

UNITED STATES PATENT AND TRADEMARK OFFICE

CERTIFICATE OF CORRECTION

PATENT NO. : 4,877,355

DATED : October 31, 1989

INVENTOR(S) : NORMAN VAN PELT

It is certified that error appears in the above-identified patent and that said Letters Patent is hereby corrected as shown below:

Col.3, line 28, "provided" should be --provide--.

Col.7, line 20, "sleds 56,58" should be --runners 52 and 54--.

Col.9, line 6, "are" should be --and--.

Col.9, line 50, "assemble" should be --assembly--.

Claim 1, col.10, line 45, "of" should be --to-- and "slurray" should be --slurry--.

Claim 1, col.10, line 66, "pressure" should be --pressures--.

Claim 2, col.11, line 4, after "by" insert --said front sled portion of said each--.

Claim 21, col.14, line 1, "cutting" should be --cuttings--.

UNITED STATES PATENT AND TRADEMARK OFFICE

CERTIFICATE OF CORRECTION

PATENT NO. : 4,877,355

DATED : October 31, 1989

INVENTOR(S) : Norman Van Pelt

It is certified that error appears in the above-identified patent and that said Letters Patent is hereby corrected as shown below:

Claim 26, col. 14, line 53, "bellmuth" should be --bellmouth--.

Claim 40, col. 18, line 19, the period after "slurry" should be a comma --,--.

Signed and Sealed this

Sixteenth Day of July, 1991

*Attest:*

*Attesting Officer*

HARRY F. MANBECK, JR.

*Commissioner of Patents and Trademarks*